United States Patent [19]

Kienel

[11] 4,132,183

[45] Jan. 2, 1979

[54] METHOD AND APPARATUS FOR SEAMING HOSIERY BLANKS

[76] Inventor: Joseph E. Kienel, Drawer K, Ackworth, Ga. 30101

[21] Appl. No.: 765,747

[22] Filed: Feb. 4, 1977

[51] Int. Cl.[2] ..... D05B 21/00

[52] U.S. Cl. ..... 112/262; 112/121.15

[58] Field of Search ..... 112/262, 121.15, 121.11, 112/121.29, 2, 102; 223/39, 41, 42, 112

[56] References Cited

U.S. PATENT DOCUMENTS

| | | | |
|---|---|---|---|
| 3,351,033 | 11/1967 | Kienel | 112/121.15 |
| 3,429,284 | 2/1969 | Bryan | 112/121.15 |
| 3,439,637 | 4/1969 | Haselgrove et al. | 112/121.15 |
| 3,875,880 | 4/1975 | Haselgrove et al. | 112/121.15 |

*Primary Examiner*—H. Hampton Hunter

*Attorney, Agent, or Firm*—Bell, Seltzer, Park & Gibson

[57] ABSTRACT

A method and apparatus for forming a highly arcuate or "fish mouth" seam in the open end portion of hosiery blanks to form the toe therein, and which comprises a disk rotatable about a vertical axis and having a plurality of pairs of cooperating clamping members disposed about the periphery thereof. The underlying clamping member of each pair is fixed to the disk, and the overlying clamping member is vertically movable as well as pivotable about an instantaneous axis which is parallel to the rotational axis of the disk. Thus the end portion of the hosiery to be seamed may be clamped between the plates as the disk is rotated, and the overlying clamping member and clamped hosiery blank then pivoted about the instantaneous axis as the hosiery passes a seaming machine, to thereby form a highly arcuate seam line therein.

10 Claims, 7 Drawing Figures

METHOD AND APPARATUS FOR SEAMING HOSIERY BLANKS

The present invention relates to a method and apparatus for seaming the open end portion of hosiery blanks along an arcuate seam line to form the toe of the hosiery therein.

The applicant's prior U.S. Pat. No. 3,351,033 relates to a method and apparatus for closing one end of circularly knit hosiery blanks to form the foot portion of the finished hose, and more particularly, the toe portion thereof. In this prior invention, the hosiery blanks are clamped between one of a number of pairs of clamping jaws which are positioned about the periphery of a circular plate, and with the portion to be seamed extending outwardly beyond the periphery of the plate in a substantially horizontal plane and radially from the plate. Upon rotation of the plate, the clamped hosiery is moved past a seaming machine to impart a curved seam which is approximately concentric to the periphery of the plate. The prior patent also discloses a form associated with each pair of clamping jaws to facilitate the initial everting of the blank and for supporting the blank during seaming, and a vacuum system for drawing the seamed hosiery through the form to thereby again evert the blank.

It has also been proposed to form a highly arcuate or "fish mouth" seam in the end of hosiery blanks in order to make more efficient use of the given length of the welt on which the seam is formed. In such prior methods, the hosiery is positioned on a form and the end to be seamed is stretched to approximately twice its relaxed width. The stretched end is then seamed along a generally circular seam line, and upon release, the hosiery returns to its original dimensions and the seam line condenses to obtain the desired arcuate contour. However, the required stretching operation not only requires a relatively complex mechanism, but in addition, the sewing operation must be slowed to avoid an undue number of stitches per inch when the seam line subsequently condenses. Also, the stretching mechanism must be modified for each change in hosiery size being processed.

It is accordingly an object of the present invention to provide a method and apparatus for seaming hosiery blanks wherein a highly arcuate or "fish mouth" seam may be formed in the end of the hosiery while the end is in a relaxed, non-stretched condition.

It is a further object of the present invention to provide a method and apparatus for seaming hosiery blanks which is adapted to accommodate various sizes of hosiery without modification of the apparatus.

It is another object of the present invention to provide a method and apparatus for seaming hosiery blanks wherein the configuration of the arcuate seam may be readily controlled and varied between a generally circular configuration and a highly arcuate configuration, to thereby permit the seam to have a maximum arch on a given welt length.

These and other objects and advantages of the present invention are achieved in the embodiment illustrated herein by the provision of a method and apparatus which includes the steps of clamping and flattening the end portion of the hosiery blank between a pair of cooperating clamping members, moving the clamping members and clamped hosiery blank along a curved path of travel defining a segment of an arc of a circle and a first axis, and such that the flattened outwardly projecting end portion lies in the plane defined by the path of travel and passes a seaming station. As the end portion passes the seaming station, at least one of the clamping members is pivoted about an instantaneous second axis which lies parallel to the first axis. The projecting end portion of the hosiery is caused to pivot with the pivoting member, and the end portion is seamed as it moves past the seaming station to form a highly arcuate seam in the blank.

In the preferred embodiment as illustrated herein, a plurality of pairs of clamping members are disposed about the periphery of a supporting disk. In operation, the disk is rotated such that the hosiery blanks may be successively clamped between each of the pairs of clamping members, and successively conveyed past the seaming station in the manner described above.

Some of the objects having been stated, other objects will appear as the description proceeds, when taken in connection with the accompanying drawings, in which —

In specifically describing the apparatus of the present invention, it will be understood that the present invention relates to an apparatus which is similar in certain basic respects to the apparatus disclosed in applicant's prior U.S. Pat. No. 3,351,033, the disclosure of which is specifically incorporated herein by reference. In the interest of highlighting the present invention, only the novel aspects of the invention are specifically described herein, and reference may be made to the prior patent for a description of the auxiliary or supporting components which may be employed with the present invention.

Figures 1, 2:
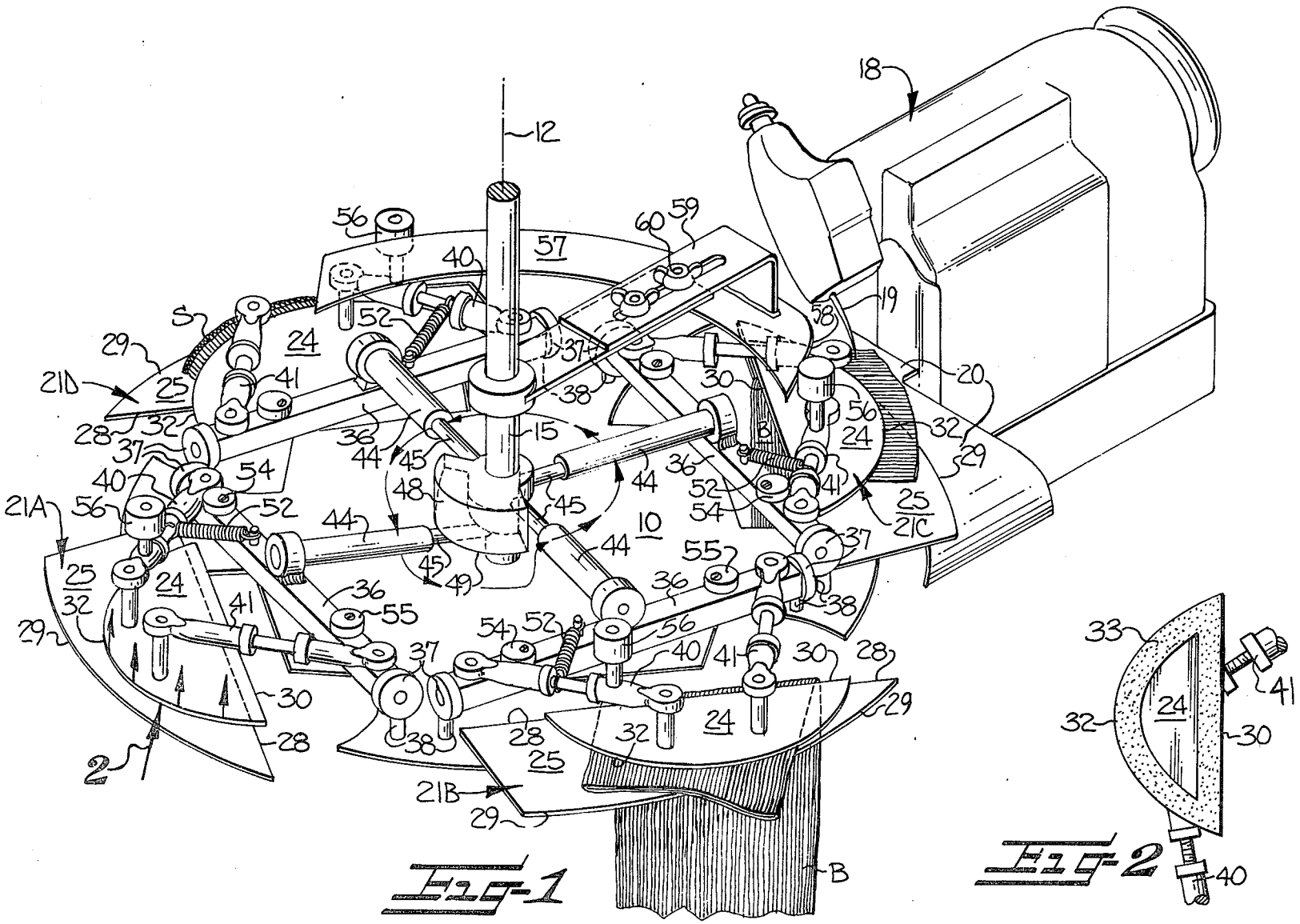
FIG. 1 is a fragmentary perspective view of an apparatus for seaming hosiery blanks and which embodies the features of the present invention.
FIG. 2 is a bottom plan view of the undersurface of one of the clamping members and looking in the direction of the arrow 2 in FIG. 1.
Figure 7:
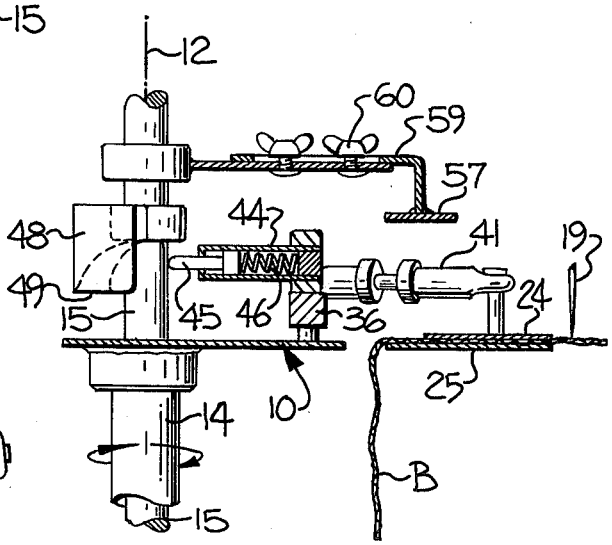
FIG. 7 is a sectional elevation view taken substantially along the line 7—7 of FIG. 4, and illustrating the means for automatically opening and closing the clamping members.

Referring more specifically to the drawings of the present invention, FIG. 1 illustrates a generally circular supporting disk 10 which is mounted for rotation about a vertical axis 12. More particularly, the disk 10 is horizontally disposed, and is rotatably mounted to the frame of the apparatus by means of a vertically directed sleeve 14 (FIG. 7) which is mounted for rotation about a fixed vertical post 15. The disk 10 is fixed to the sleeve, and the sleeve is adapted to be rotated by suitable drive means (not shown), to thereby rotate the disk 10 about the axis 12.

A seaming machine 18 is mounted immediately adjacent the periphery of the disk 10. The seaming machine 18 is conventional, and typically comprises an overedge sewing machine having at least one needle 19, a throat plate 20, and a knife (not shown) for severing excess material from the hosiery blank B concurrently with the formation of the seam S.

A total of four pairs of overlying clamping members 21A, 21B, 21C, and 21D are positioned about the periphery of the disk so as to move along a circular path of travel as the disk rotates. As hereinafter further described, each pair of clamping members comprises an upper member 24 and cooperating lower member 25, which serve to releasably clamp and flatten the end portion of a hosiery blank B therebetween, such that the flattened end portion projects radially outwardly from the axis 12 and lies substantially in the plane defined by the circular path of travel of the clamping members. In the illustrated embodiment, the plane defined by the circular path of travel conforms to the plane defined by the disk 10. In addition, the upper clamping member 24 of each pair pivots about an instantaneous second vertical axis 26 (note FIGS. 3–5) as the pair passes the seaming machine 18, and the end portion of the hosiery blank B is caused to pivot with the pivoting clamping member 24. By this arrangement, the end portion of the hosiery blank is both rotated about the first axis 12 and pivoted about the second axis 26 during the seaming operation, to thereby impart a highly arcuate, or "fish mouth" seam.

To more specifically describe the structure of the illustrated apparatus, means are provided for mounting each pair of clamping members along the periphery of the disk 10, such that the clamping members may be selectively opened and closed with respect to each other, and further such that at least one of the clamping members is pivotable about the instantaneous second vertical axis 26. The lower clamping member 25 is in the form of a horizontally disposed flat plate which is fixed to the disk 10, and which is fabricated from a relatively smooth metallic material or the like to define a low friction, upwardly facing surface. The member 25 also includes a curved outer edge 29 which lies along an arc of a circle disposed about the axis 12, and a straight edge surface 28 disposed along a chord of such circle, and with the surface 28 extending from such circle in a direction opposite the direction of rotation.

The upper clamping member 24 has a generally D-shaped outline, and includes an inner straight edge surface 30, and an outer arcuate surface 32 which lies along an arc of a circle of considerably shorter radius than that of the surface 29. The member 24 further includes a downwardly facing surface having a resilient or elastomeric material 33 adhered thereto (note FIG. 2) to define a high friction surface.

The member 24 of each pair of clamping members is mounted to the disk 10 by an arrangement which includes a horizontally disposed tilt bar 36 carried by the disk and disposed perpendicular to a radial line from the axis 12 and which intersects the bar at a point midway along its length. Each end of the bar 36 is rotatably supported by a bearing 37 which is in turn fixed to the disk by a post 38, and such that the bar 36 is rotatable about its horizontal axis. In addition, a pair of arms 40, 41 interconnect the bar and upper clamping member 24, with one end of each arm being pivotally mounted to the bar 36 and the other end being pivotally mounted to the clamping member 24. Thus the bar 36, two arms 40, 41 and clamping member 24 comprise a four bar linkage, with the clamping member 24 being translatable and rotatable about the instantaneous axis 26 with respect to the disk. In this regard, the axis 26 is located at the intersection of imaginary extensions of the arms 40, 41 and as will be apparent from FIGS. 3–5, the axis 26 moves along an arcuate path of travel with respect to the disk and adjacent the periphery thereof. Also, it will be seen that the rotational direction of movement of the clamping member 24 about the axis 26 is common to the rotational directional movement of the clamping members about the first axis 12 when the clamping member passes the seaming machine 18.

The upper clamping member 24 is also movable between a closed position as seen at positions 21B, 21C, and 21D in FIG. 1, and a vertically separated or opened position as seen at 21A, by reason of the pivotable movement of the bar 36 about its horizontal axis. To automatically control this pivotal movement, there is provided a tilt arm 44 fixed to and extending radially inwardly from the bar 36, and the arm 44 includes a plunger 45 at the inner end thereof which is adapted to engage the fixed post 15. The plunger 45 is biased outwardly by the spring 46 (FIG. 7), such that a biasing force is exerted through the plunger and tilt arm 44 to bias the clamping member 24 toward its closed position in contact with the lower member 25.

A cam 48 is also fixedly disposed on the post 15, the cam 48 including a cam surface 49 which is adapted to be engaged by the plunger 45 to pivot the plunger downwardly about the axis of the bar 36, and thereby pivot the clamping member 24 to its open position, during a predetermined segment of the rotation of the disk.

Figure 3:
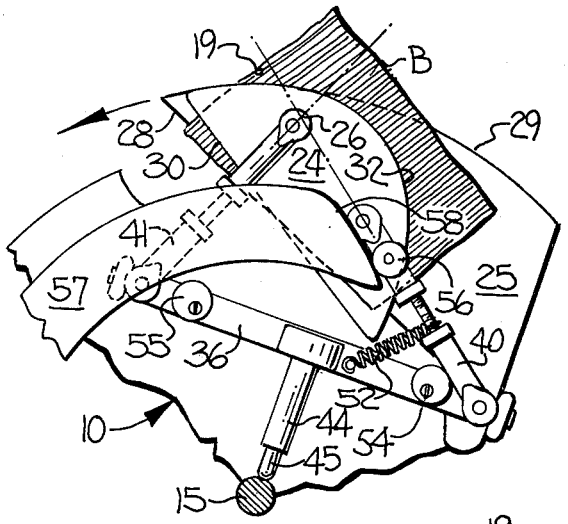
FIGS. 3–5 are corresponding plan views of one of the pairs of clamping members and taken at the beginning, midpoint, and end of the seaming operation, respectively.
Figure 4:
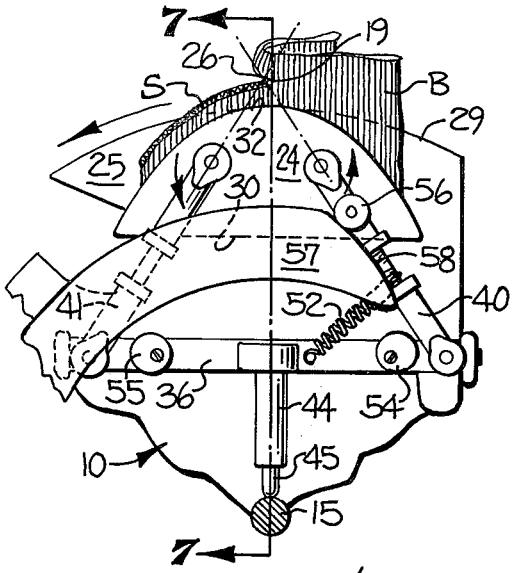
Figure 5:
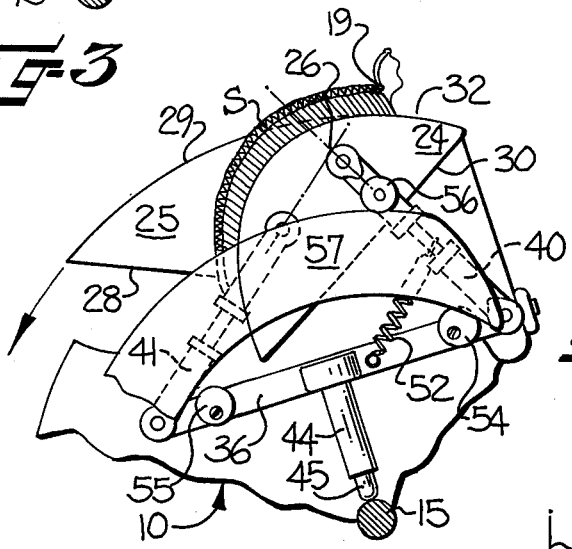

The apparatus of the present invention further includes means for selectively pivoting the upper clamping member 24 of each pair about the instantaneous vertical axis 26 during that portion of the path of travel adjacent the seaming machine 18. In this regard, a spring 52 interconnects the arm 40 and bar 36, and serves to bias the arm 40 in a counterclockwise direction as seen in FIGS. 3–5. To limit such movement, and thereby define an initial position for the arms 40, 41 and clamping member 24 (FIG. 3), there is provided an eccentric 54 which is rotatably mounted on the bar 36 immediately adjacent the arm 40. A second eccentric 55 is positioned on the bar 36 adjacent the arm 41 to limit inadvertent rotational movement in the opposite direction.

The pivoting means further comprises cam means for pivoting the arm 40 in a clockwise direction and thereby translate and rotate the clamping member 24 from the initial position and to a final position (FIG. 5) as it moves past the seaming machine. More particularly, the cam means comprises a cam follower 56 carried by the arm 40, and a cam 57 fixedly mounted with respect to the first axis 12 and in a position to operatively engage the cam follower 56 as the clamping members move past the seaming machine 18. More particularly, the cam 57 comprises a plate having an arcuately shaped forward edge 58, and which is secured to the fixed post 15 by the bracket 59. The bracket is in two segments, which are adjustably interconnected by the slot and stud arrangement 60, whereby the cam 57 may be selectively moved along a radial line with respect to the first axis 12. As will become apparent, such radial movement permits control of the final position of the clamping member 24, and thus the shape of the resulting seam S in the hosiery blank B.

In operation, the disk 10 is preferably continuously rotated at a constant speed, so that the pairs of clamping members sequentially pass the seaming machine 18. Viewing FIG. 1, it will be seen that the clamping members of pair 21A are vertically separated by the action of the cam 48 in lowering the plunger 45. At this position, the operator places the end of the hosiery blank B upon the upper surface of the clamping member 25 and so that the end portion lies across and extends perpendicular to the edge surface 28. As the disk 10 rotates to the position of the pair 21B, the plunger 45 is released by the cam 48, resulting in the upper clamping member 24 being biased downwardly by the spring 46 to thereby clamp the hosiery blank B between the clamping members. In this regard, it will be noted that the spring 52 acts to hold the upper clamping member 24 in its initial position as seen in FIG. 3.

Continued rotation of the disk 10 causes the clamped and flattened hosiery blank B to approach the seaming machine 18, with the leading edge of the blank approaching the machine at an acute angle, note FIG. 3. The severing and seaming operation is then commenced, and the cam follower 56 concurrently engages the cam 57. By design, the cam 57 acts through the follower 56 to pivot the arms 40, 41 with respect to the tilt bar 36, and also causes the clamping member 24 to both translate and rotate about the instantaneous vertical axis 26. As the clamping members move downstream of the seaming machine 18, the plunger 45 contacts the cam 48 on the post 15, which acts to depress the plunger and lift the clamping member 24 to its original open position. The seamed hosiery blank is then removed and the cycle of operation repeated.

Figure 6:
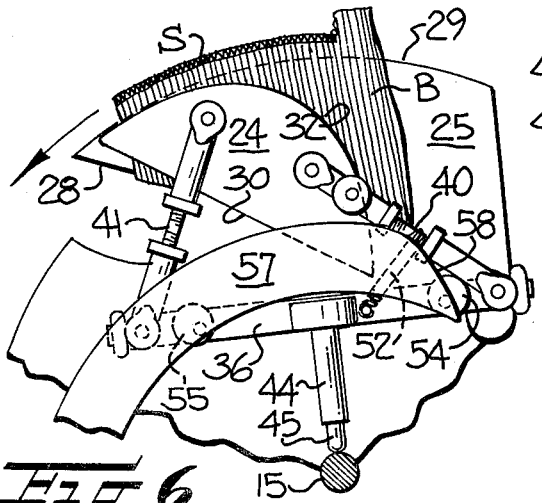
FIG. 6 is a view similar to FIGS. 3–5, but illustrating the means for pivoting the clamping members in an inactive configuration, to thereby form a seam line of minimum curvature in the hosiery.

In accordance with the present invention, the extent of the curvature of the seam S may be selectively controlled and varied between a highly arcuate configuration and a generally circular configuration. In this regard, the cam 57 may be radially adjusted by means of the adjustable interconnection at 60 to fully rotate the member 24 about the axis 26 and thereby impart maximum curvature to the seam as in FIGS. 3–5, or the cam 57 may be fully withdrawn as seen in FIG. 6 so that the member 24 is not rotated to thereby impart a minimum curvature which corresponds to the arc of the circle defined by a radius extending from the axis 12 to the needle 19 of the seaming machine 18. Also, the cam 57 may be disposed at any intermediate position, to impart an intermediate curvature.

In the drawings and specification, there has been set forth a preferred embodiment of the invention, and although specific terms are employed, they are used in a generic and descriptive sense only and not for purposes of limitation.

That which is claimed is:

1. A method of seaming the open end portion of a hosiery blank along an arcuate seam line of predetermined curvature to form the toe of the hosiery, and comprising the steps of conveying a hosiery blank along a curved path of travel which defines an arc of a circle and a first axis, and such that the end portion of the hosiery blank to be seamed protrudes radially outwardly from the first axis, while pivoting the end portion of the blank about an instantaneous second axis which lies parallel to the first axis during the movement of the blank along such curved path of travel, and while seaming the projecting end portion to close the end of the hosiery blank and form the toe therein.

2. The method as defined in claim 1 wherein said curved path of travel defines a plane, with said first and second axes extending perpendicular to said plane.

3. The method as defined in claim 2 wherein said conveying step includes flattening the end portion of the hoisery blank such that the flattened end portion is substantially disposed in said plane.

4. A method of seaming the open end portion of a hosiery blank along an arcuate seam line of predetermined curvature to form the toe of the hosiery, and comprising the steps of clamping and flattening the end portion of the hosiery blank to be seamed between a pair of cooperating clamping members such that the flattened end portion projects outwardly from the members, moving the clamping members and clamped hosiery blank along a curved path of travel which defines at least an arc of a circle and a first axis, and such that the flattened outwardly projecting end portion lies in the plane defined by the path of travel and passes a seaming station, pivoting at least one of the clamping members about an instantaneous second axis which lies parallel to said first axis as the end portion passes the seaming station, and causing the projecting end portion to pivot with the pivoting clamping member, during a portion of the movement of the clamping members along such curved path of travel, and seaming the projecting end portion as it moves past the seaming station to form the toe in the blank.

5. The method as defined in claim 2 wherein said instantaneous second axis moves along a path of travel with respect to said disk and adjacent the periphery thereof.

6. The method as defined in claim 5 wherein the direction of movement of said clamping members about said first axis is common to the rotational direction in which said one clamping member pivots about said instantaneous axis.

7. The method as defined in claim 6 comprising the further subsequent step of separating the pair of clamping members to release the hosiery blank.

8. A method of seaming the open end portion of hosiery blanks along an arcuate seam line to form a closed toe, and comprising the steps of successively clamping a hosiery blank between each of a plurality of pairs of clamping members which are positioned about the periphery of a supporting disk which is rotatable about a first vertical axis, and such that the end portion of each hosiery blank is flattened and projects radially outwardly from the associated clamping members substantially in the plane of said disk, rotating the supporting disk about the first vertical axis such that the clamped hosiery blanks are successively conveyed along a curved path of travel which defines at least an arc of a circle, pivoting at least one of the clamping members of each pair about an instantaneous second vertical axis during a predetermined segment of the curved path of travel, and causing the projecting end portion of the associated hosiery blank to pivot therewith, seaming the projecting end portion of each hosiery blank by passing the end portion through a seaming machine which is positioned adjacent the predetermined segment of the path of travel, and while the end portion is both rotating about the first axis and pivoting about the second axis, and successively separating the clamping members after passing the seaming machine to successively release the blanks.

9. The method as defined in claim 8 wherein the step of rotating the supporting disk includes continuously rotating the same about the first vertical axis.

10. A method of seaming the open end portion of a hosiery blank along an arcuate seam line of predetermined curvature to form the toe of the hosiery, and comprising the steps of clamping and flattening the end portion of the hosiery blank to be seamed between a pair of cooperating clamping members which are mounted adjacent the periphery of a supporting disk which is rotatable about a first axis, and such that the flattened end portion projects outwardly from the members, moving the clamping members and clamped hosiery blank along a curved path of travel by rotating said disk about said first axis, and such that the flattened outwardly projecting end portion lies substantially in the plane defined by the path of travel and passes a seaming station, pivoting one of the clamping members about an instantaneous second axis which lies parallel to said first axis as the end portion passes the seaming station, and causing the projecting end portion to pivot with the pivoting clamping member, and including both translating and rotating said one member with respect to said disk while maintaining the other of said members stationary with respect to said disk, and seaming the projecting end portion as it moves past the seaming station to form the toe in the blank.

* * * * *